US010781550B2

(12) United States Patent
Mazzarella et al.

(10) Patent No.: US 10,781,550 B2
(45) Date of Patent: Sep. 22, 2020

(54) COMPOSITE MATERIAL STRUCTURAL PANEL HAVING AN INTEGRAL AIR CHANNEL

(71) Applicant: WHIRLPOOL CORPORATION, Benton Harbor, MI (US)

(72) Inventors: Antonio Mazzarella, Fabriano (IT); Samir Nimkar, Pune (IN); Pedro A. Rouin, Benton Harbor, MI (US); Gianbattista Pirola, Bergamo (IT)

(73) Assignee: Whirlpool Corporation, Benton Harbor, MI (US)

( * ) Notice: Subject to any disclaimer, the term of this patent is extended or adjusted under 35 U.S.C. 154(b) by 124 days.

(21) Appl. No.: 16/017,343

(22) Filed: Jun. 25, 2018

(65) Prior Publication Data

US 2019/0390394 A1 Dec. 26, 2019

(51) Int. Cl.

| | |
|---|---|
| ***F26B 3/00*** | (2006.01) |
| ***D06F 58/04*** | (2006.01) |
| ***D06F 58/10*** | (2006.01) |
| ***D06F 58/22*** | (2006.01) |

(52) U.S. Cl.

CPC ..... *D06F 58/04* (2013.01); *D06F 58/10* (2013.01); *D06F 58/22* (2013.01)

(58) Field of Classification Search

CPC ..... D06F 58/00; D06F 58/04; D06F 58/06; D06F 58/22; D06F 58/10; D06F 58/20

USPC ..... 34/480, 121, 603

See application file for complete search history.

(56) References Cited

U.S. PATENT DOCUMENTS

| | | | | |
|---|---|---|---|---|
| 4,817,297 | A | 4/1989 | Toma et al. | |
| 4,854,054 | A | 8/1989 | Johnson | |
| 7,024,802 | B2 | 4/2006 | Myung | |
| 7,322,125 | B2 | 1/2008 | Byun et al. | |
| 7,640,678 | B2 | 1/2010 | Lee et al. | |
| 7,946,054 | B2 | 5/2011 | Dittmer et al. | |
| 8,191,388 | B2 | 6/2012 | Kim et al. | |
| 8,555,523 | B2 | 10/2013 | Dittmer et al. | |
| 8,601,719 | B2 | 12/2013 | Lee et al. | |
| 9,127,399 | B2 | 9/2015 | Chatot et al. | |
| 9,297,493 | B2 * | 3/2016 | Bison | D06F 58/06 |
| 9,488,412 | B2 | 11/2016 | Yu et al. | |
| 9,574,298 | B2 | 2/2017 | Sartor et al. | |
| 2004/0221479 | A1 | 11/2004 | Lee et al. | |

(Continued)

FOREIGN PATENT DOCUMENTS

| | | |
|---|---|---|
| EP | 2990519 | 3/2016 |

OTHER PUBLICATIONS

Impact Plastics, 5 Reasons to use Calcium Carbonate filled polypropylene sheet, Jan. 31, 2018, pp. 1-4 (Year: 2018).*

*Primary Examiner* — John P McCormack

(74) *Attorney, Agent, or Firm* — Price Heneveld LLP

(57) ABSTRACT

A laundry appliance includes a drum that processes laundry. A blower delivers process air from a heater to the drum via an airflow path. A structural panel defines a front aperture for accessing an interior of the drum and an air channel that defines a portion of the airflow path. The structural panel includes a lower first portion that is made of a first material and an upper second portion that is made of a second material that is different from the first material. The first and second materials meet at a predetermined seam that extends through the structural panel and the air channel.

20 Claims, 10 Drawing Sheets

(56) References Cited

U.S. PATENT DOCUMENTS

| | | | | |
|---|---|---|---|---|
| 2005/0126034 | A1* | 6/2005 | Jeong | D06F 58/04 34/602 |
| 2005/0155394 | A1 | 7/2005 | Brauchle | |
| 2006/0265899 | A1* | 11/2006 | Renzo | D06F 58/04 34/603 |
| 2006/0289533 | A1* | 12/2006 | Park | D06F 39/12 219/757 |
| 2009/0083987 | A1 | 4/2009 | Prajescu | |
| 2009/0126417 | A1* | 5/2009 | Ripley | D06F 39/14 68/196 |
| 2010/0192640 | A1* | 8/2010 | Gracia Bobed | D06F 37/262 68/212 |
| 2013/0255098 | A1* | 10/2013 | Cavarretta | D06F 58/02 34/108 |
| 2013/0255099 | A1 | 10/2013 | Cavarretta et al. | |
| 2018/0245274 | A1* | 8/2018 | Bocchino | D06F 58/22 |

* cited by examiner

COMPOSITE MATERIAL STRUCTURAL PANEL HAVING AN INTEGRAL AIR CHANNEL

FIELD OF THE DEVICE

The device is in the field of laundry appliances, and more specifically, a structural panel for a laundry appliance that includes a portion of an airflow path integrally formed within the structural panel.

SUMMARY

In at least one aspect, a laundry appliance includes a drum that processes laundry. A blower delivers process air from a heater to the drum via an airflow path. A structural panel defines a front aperture for accessing an interior of the drum and an air channel that defines a portion of the airflow path. The structural panel includes a lower first portion that is made of a first material and an upper second portion that is made of a second material that is different from the first material. The first and second materials meet at a predetermined seam that extends through the structural panel and the air channel.

In at least another aspect, a laundry appliance includes a cabinet. A drum is disposed within the cabinet for processing laundry. A blower delivers process air from a heater to the drum via an airflow path. A structural panel defines an air channel of the airflow path. The structural panel includes a first portion that is made of a first material and a second portion that is made of a second material that is different from the first material. The first and second materials meet at a predetermined seam that extends through a perimeter wall of the structural panel that defines the air channel.

In at least another aspect, a structural panel for a laundry appliance includes a lower first portion made of a first polypropylene material. An upper second portion is made of a second polypropylene material that is different than the first polypropylene material, wherein the upper second portion defines a front aperture for accessing a rotating drum. An air channel extends from the front aperture of the upper second portion to a base of the lower first portion. The first and second materials meet at a predetermined seam that divides the lower first portion and the upper second portion. The predetermined seam extends through a perimeter wall that defines the air channel.

These and other features, advantages, and objects of the present device will be further understood and appreciated by those skilled in the art upon studying the following specification, claims, and appended drawings.

DETAILED DESCRIPTION OF EMBODIMENTS

Figure 1:
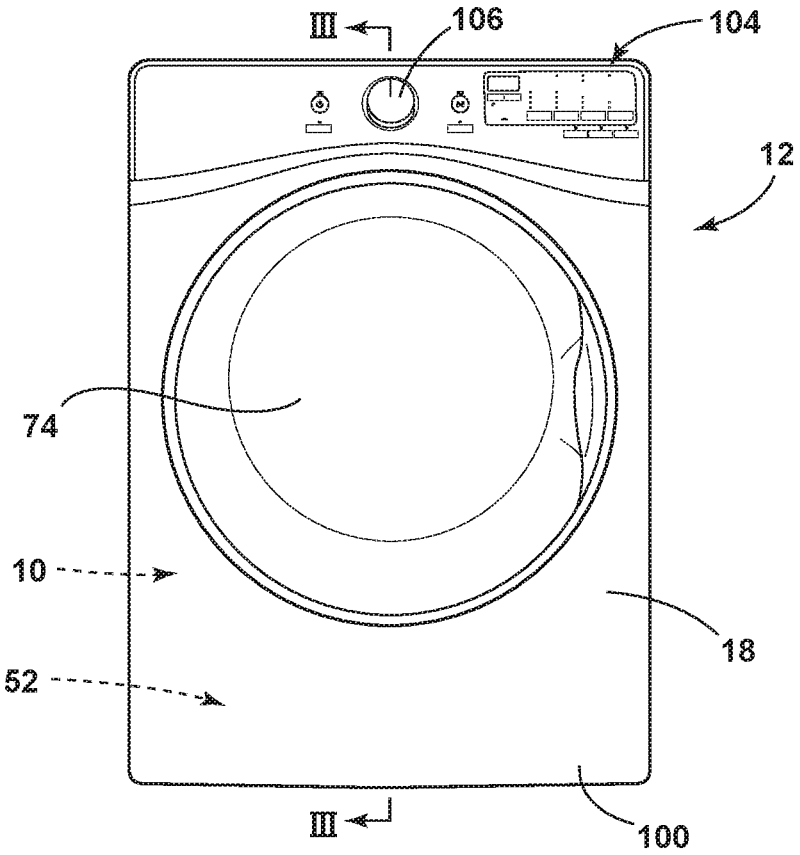
FIG. 1 is a front elevational view of a laundry appliance incorporating an aspect of the structural panel.
Figure 2:
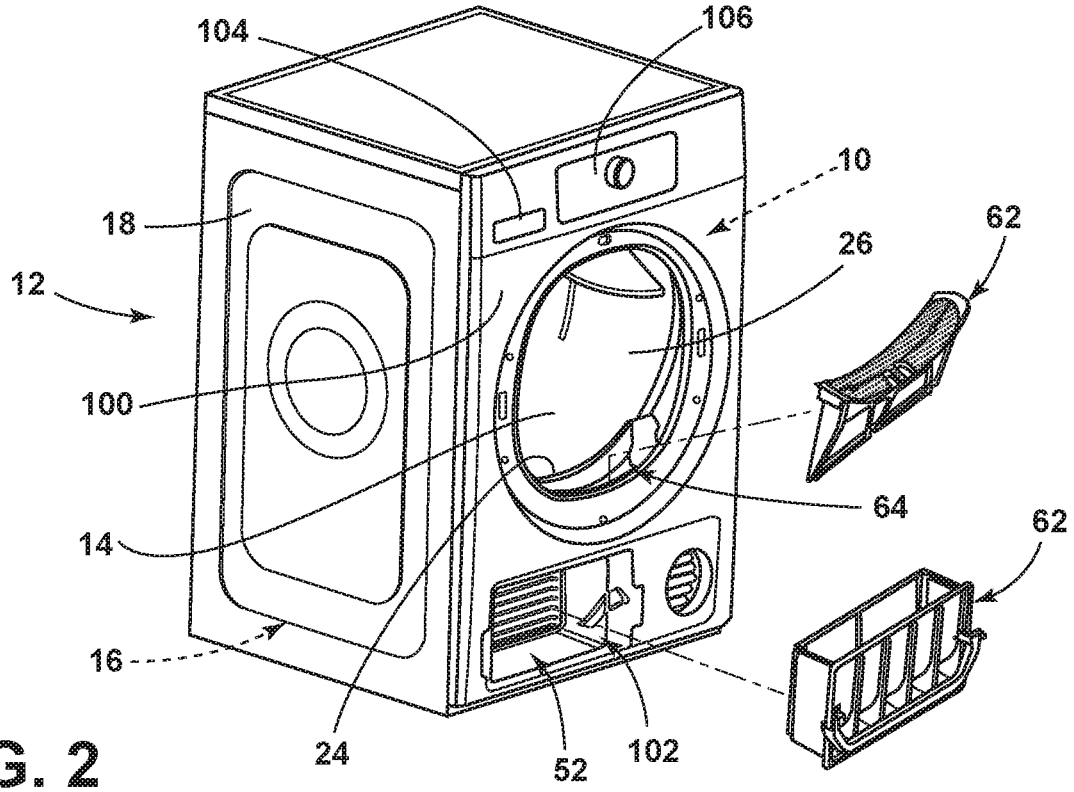
FIG. 2 is a partially exploded perspective view of an appliance incorporating an aspect of the structural panel.
Figure 3:
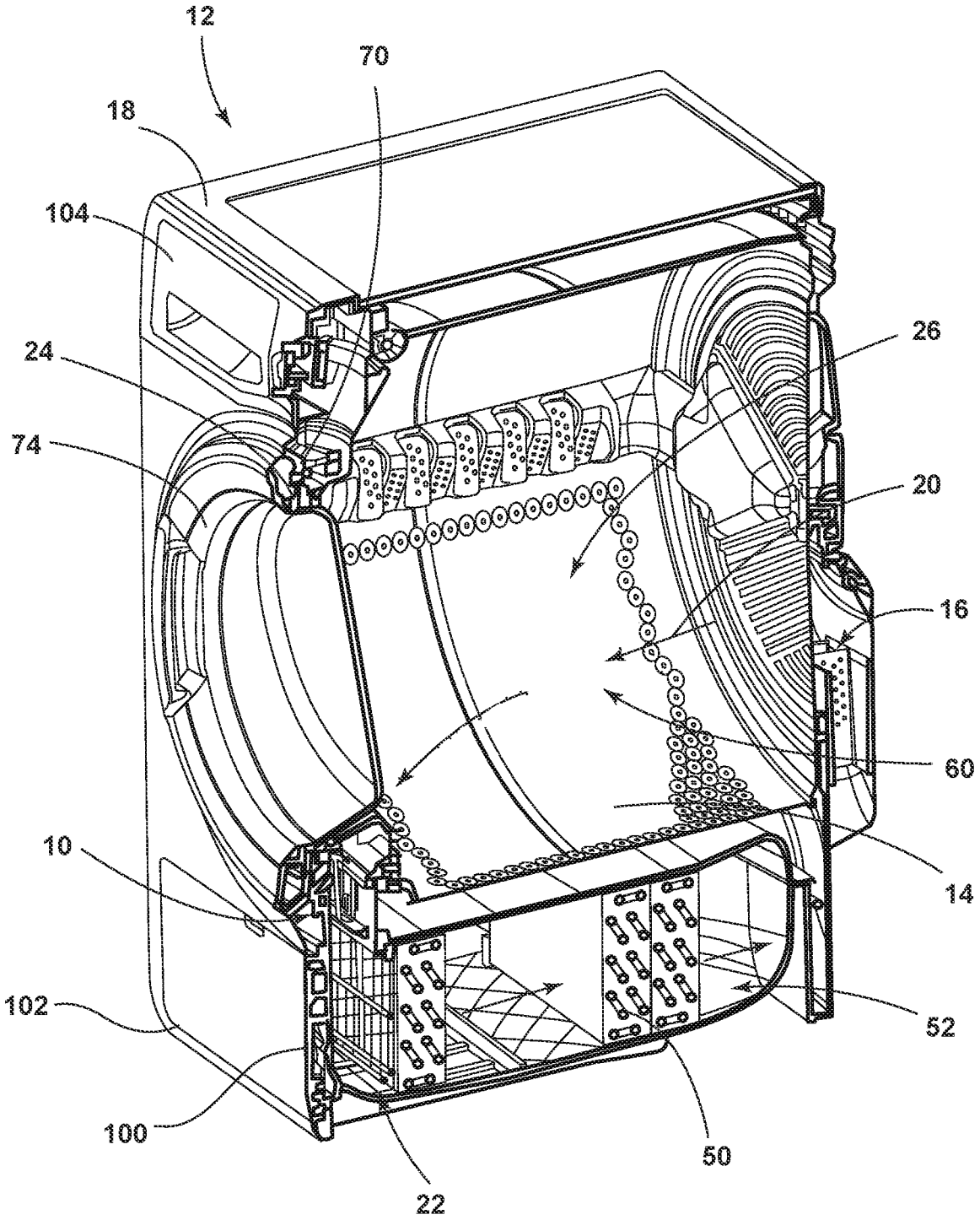
FIG. 3 is a perspective cross-sectional view of the appliance of FIG. 1 taken along line III-III.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With respect to FIGS. 1-4, reference numeral 10 generally refers to a structural panel for an appliance 12, typically a laundry appliance that includes a drum 14, typically a rotating drum 14, for processing laundry. A blower 16 is included within a cabinet 18 for the laundry appliance 12, where the blower 16 delivers process air 20 from a heater 50 to the drum 14 via the airflow path 22. The structural panel 10 defines a front aperture 24 for accessing an interior 26 of the drum 14. The structural panel 10 also includes an air channel 28 that defines a portion of the airflow path 22 for the laundry appliance 12. Typically, the structural panel 10 includes a lower first portion 30 that is made of a first material 32 and an upper second portion 34 that is made of a second material 36, where the second material 36 is different than the first material 32. The first and second materials 32, 36 meet at a predetermined seam 38 that extends through the structural panel 10. This predetermined seam 38 also extends through a perimeter wall 40 that defines the air channel 28 within the structural panel 10.

Referring again to FIGS. 1-4, the laundry appliance 12 can include the drum 14 that selectively rotates for treating laundry, such as for washing, drying, or performing other laundry processing cycles within the laundry appliance 12. A heater 50 for the laundry appliance 12 can include an electrically resistive heating element. In various aspects of the laundry appliance 12, the heater 50 can also include a heat exchange system including a compressor, an evaporator, at least one expansion device, and a refrigerant line that delivers a thermal exchange media between these components of the heat exchange system for the laundry appliance 12. The heater 50 can also be in the form of an air-to-air heat exchanger.

The heater 50 for the laundry appliance 12 can also include a gas-powered heater where fuel, such as natural gas or other similar combustible fuel is heated within a basement 52 for the appliance 12. Where a gas-powered heater is used, flames resulting from the gas-powered heater 50 are typically contained within a specific area of the basement 52 for the appliance 12.

In each of these configurations of the heater 50, the heater 50 for the laundry appliance 12 is typically disposed within the basement 52 for the laundry appliance 12. The airflow path 22 of the laundry appliance 12 operates by moving process air 20 using a blower 16. Process air 20 for treating laundry within the drum 14 is moved from the drum 14, through the air channel 28 for the structural panel 10, into the basement 52 where the process air 20 moves through or near the heater 50, and then back into the drum 14. During the drying operation of the laundry appliance 12, various particulate material such as lint, fluff and other particles, may be captured within the process air 20. One or more lint capturing devices can be disposed within the airflow path 22 for separating this particulate material from this process air 20. At least one of these lint capturing devices can be a removable lint filter 62 that is disposed within the air channel 28 for the structural panel 10. In aspects where the removable lint filter 62 is disposed within the air channel 28 for the structural panel 10, the air channel 28 can define an air filter receptacle 64 for receiving the removable air filter.

Referring again to FIGS. 1-4, the structural panel 10 is typically in the form of a front panel 70 for the appliance 12 where the front panel 70 includes the front aperture 24 through which the interior 26 of the drum 14 can be accessed for putting laundry within the drum 14 or taking laundry out from the drum 14. According to various aspects of the device, the structural panel 10 can be located in other portions of the appliance 12 or can include other aspects of the laundry appliance 12 disposed within a cabinet 18 thereof. It is contemplated that the structural panel 10 used within the appliance 12, and as disclosed herein, will include at least a portion of the airflow path 22 for the appliance 12. According to various aspects of the device, the air channel 28 for the structural panel 10 is positioned at least partially above the basement 52 for the laundry appliance 12 and typically positioned near the heater 50 for the airflow path 22. In this position, process air 20 having substantially high temperatures can be experienced within the air channel 28. These high temperatures can be the result of normal operation of the heater 50 for the airflow path 22. In various exceptional or atypical situations, incineration of certain particulate matter 60 such as lint or fluff may result in a combustion event occurring within the basement 52 and portions of the airflow path 22. Such a combustion event can occur within or near the air channel 28 for the structural panel 10. To address the potential for a combustion event within the air channel 28, the first material 32 of the lower portion of the structural panel 10 can include a heat resistant material that will assist in minimizing the effects of such an event.

In various aspects of the device, the first material 32 having heat resistant properties, typically a polypropylene-based material, can include talc-filled polypropylene, where talc makes up approximately 20 percent of the material. Such a material can have a $V_0$ rating. Such a rating is indicative of a fire-resistant material. This material is useful in addressing a potential combustion event that may occur within the appliance 12.

The upper portion of the structural panel 10 is made from a different material that can include polypropylene that is at least partially filled with calcium carbonate, or calcium tricarbonate particles. The combination of the first and second materials 32, 36 are located within the structural panel 10 to place the heat resistant material in a position to have an impact on the effect of a potential combustion event within a basement 52 of the laundry appliance 12. The upper second portion 34 of the structural panel 10 is typically less affected by the combustion event. Accordingly, the use of heat-resistant materials in the upper portion of the structural panel 10 may not be as effective in containing the effects of the combustion event. Typically, the heat-resistant first material 32, such as the talc-filled polypropylene having the $V_0$ rating is more expensive. By placing the heat-resistant first material 32 in the locations of greatest impact, the benefits of using the heat-resistant first material 32 are achieved while also utilizing less expensive materials where not as effective for mitigating the effect of the combustion event.

Referring again to FIGS. 1-4, the use of polypropylene-based materials for the first and second materials 32, 36 allows for injection molding of the first and second portions 30, 34 of the structural panel 10. Compression molding, blow molding and other molding operations can be utilized for manufacturing the structural panel 10. Each of the talc-filled polypropylene for the first material 32 and the calcium tricarbonate filled polypropylene of the second material 36 can be injection molded within a single cavity or within separate cavities. These injection molding processes will be described more fully below.

Figure 4:
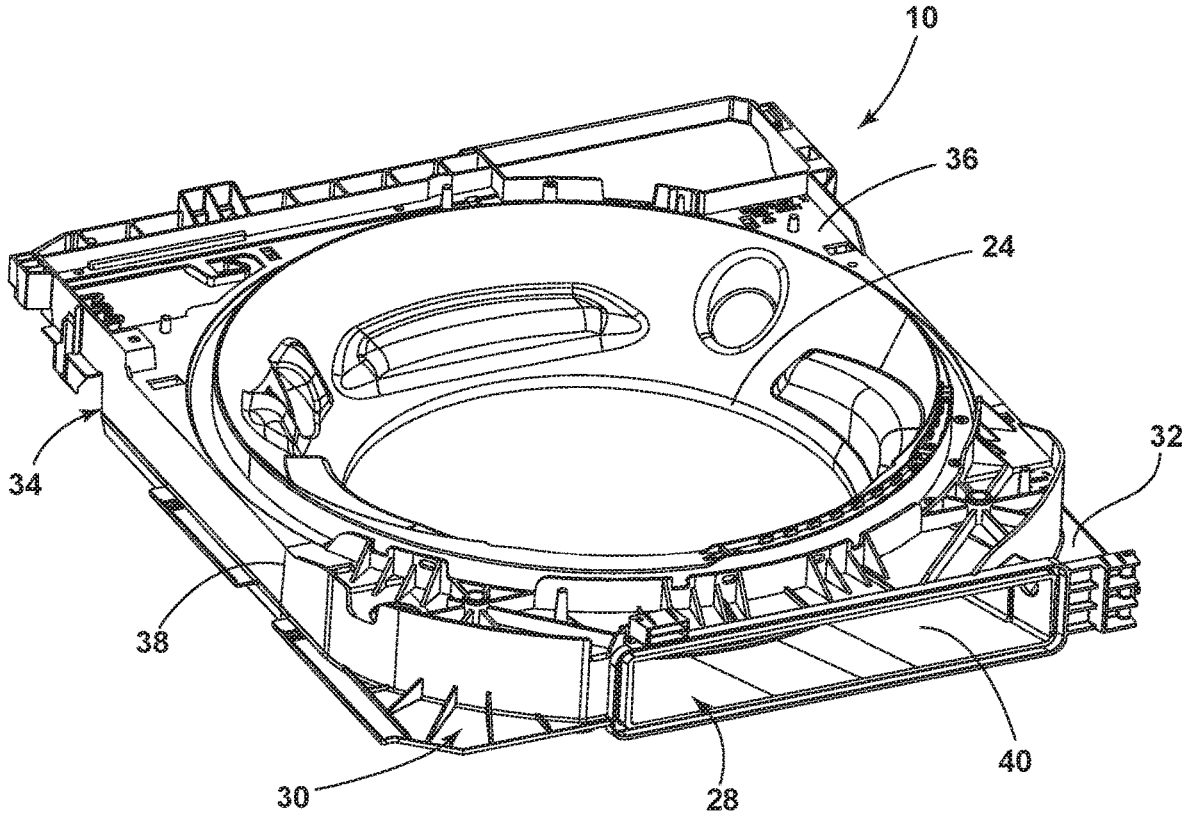
FIG. 4 is a bottom perspective view of a structural panel for the appliance that incorporates an aspect of the air channel.
Figure 5:
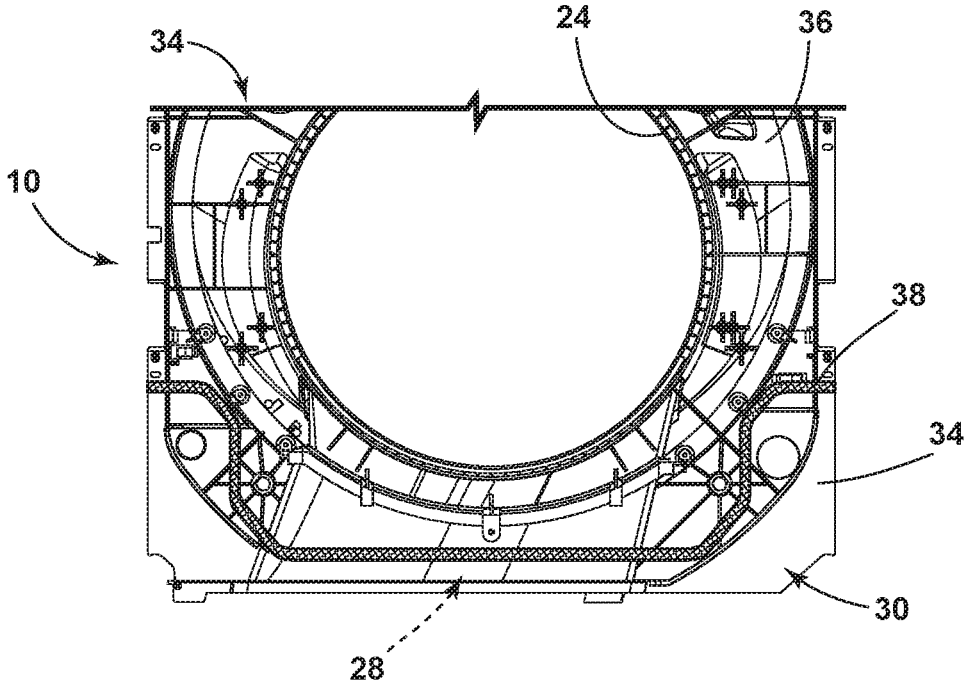
FIG. 5 is an enlarged partial elevational view of a drum-side surface of the structural panel.
Figure 6:
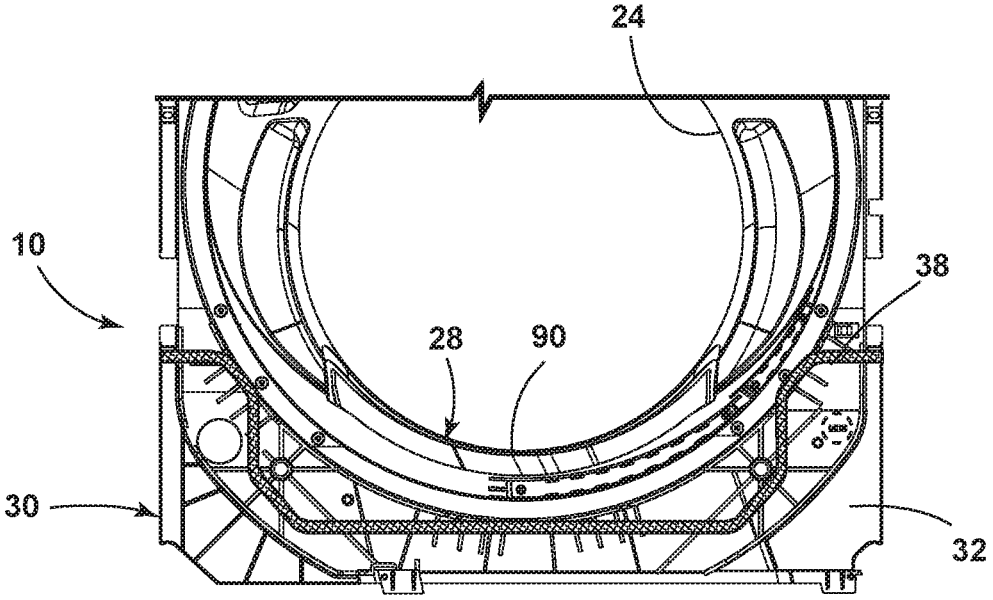
FIG. 6 is an enlarged partial elevational view of an outward-facing surface of the structural panel of FIG. 4.
Figure 7:
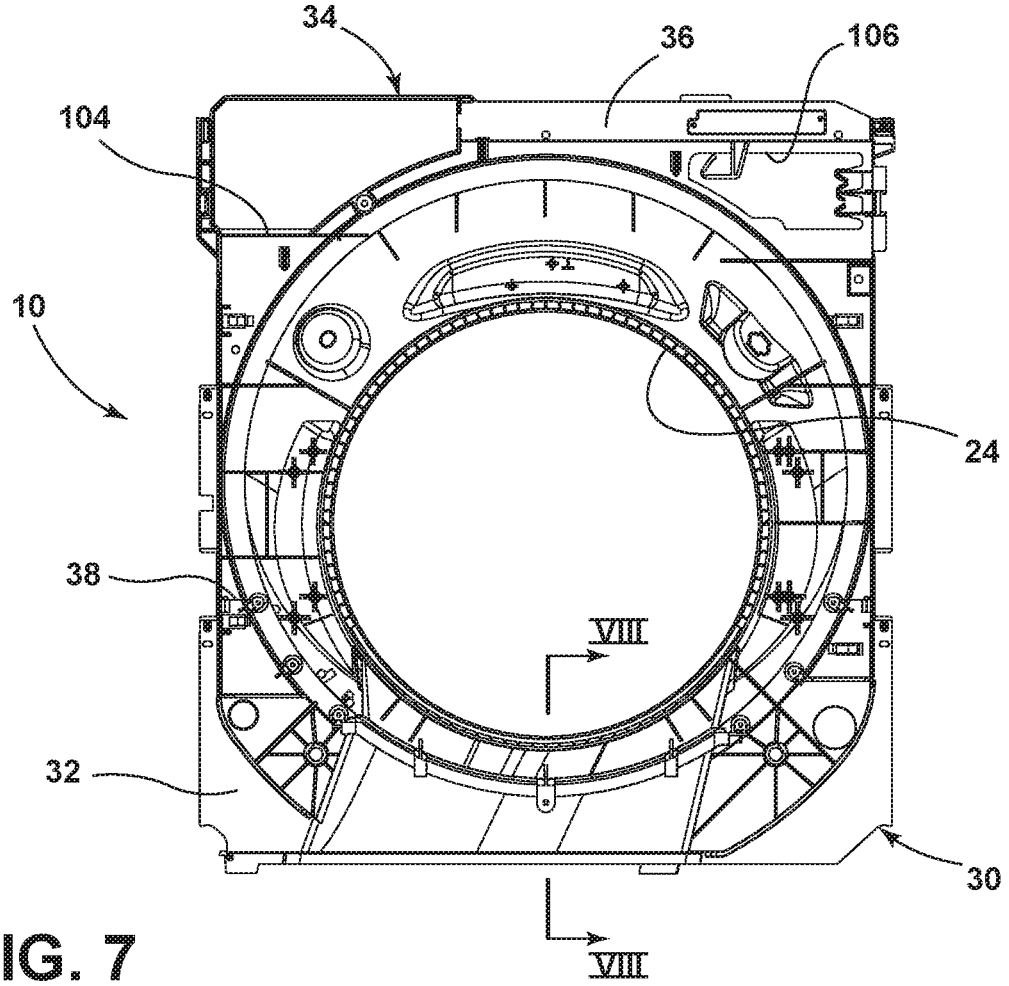
FIG. 7 is an elevational view of the structural panel of FIG. 4.
Figure 8:
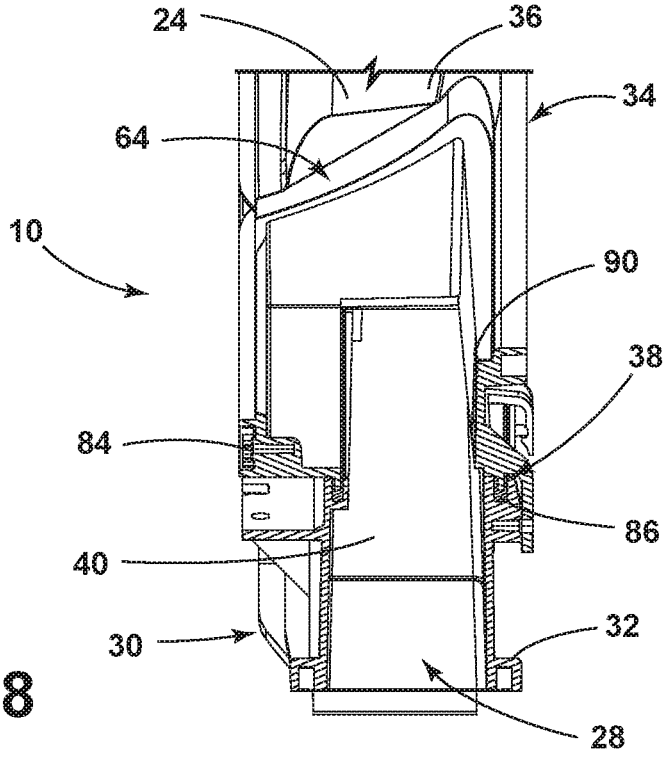
FIG. 8 is a cross-sectional view of an aspect of the air channel for the structural panel taken along line VIII-VIII.
Figure 9:
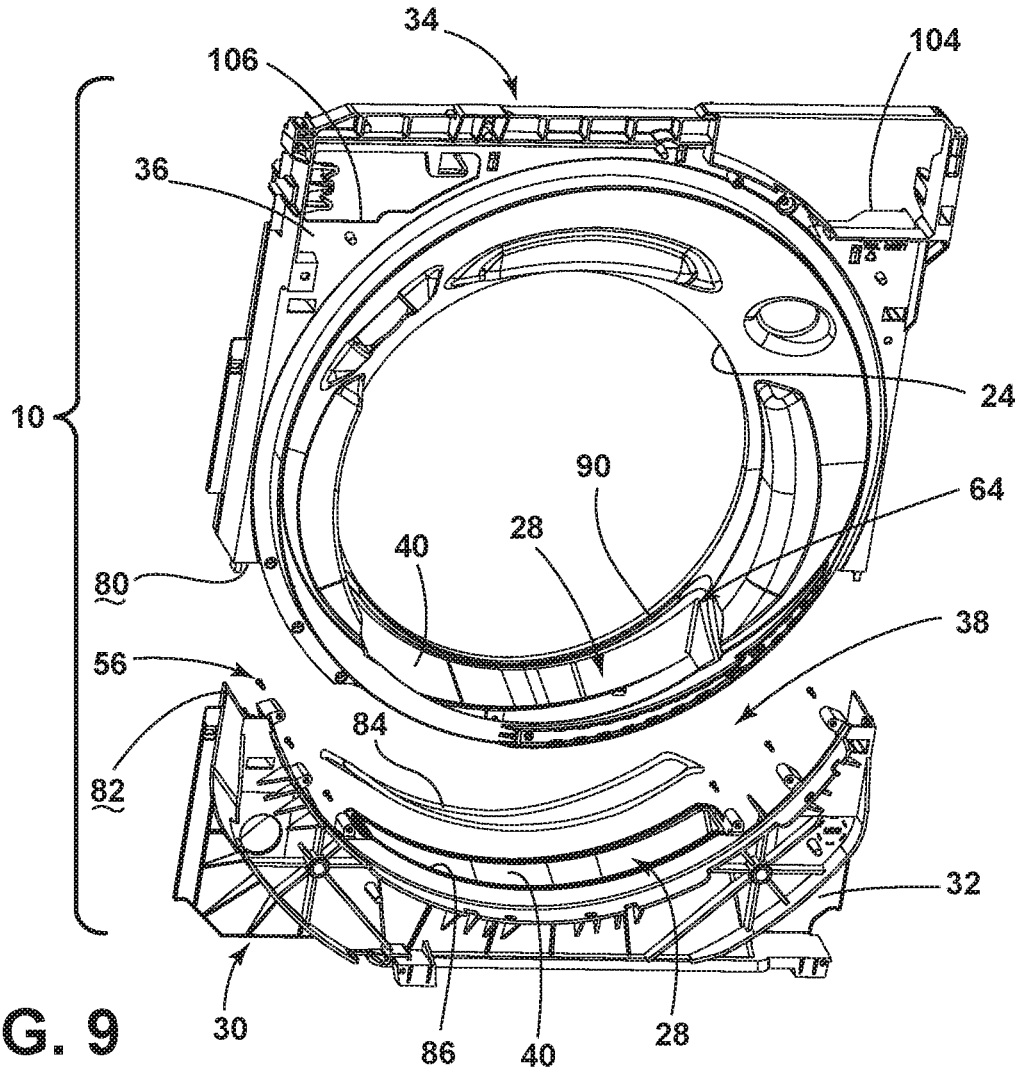
FIG. 9 is an exploded perspective view of an aspect of the structural panel incorporating a sealing member that extends around the air channel.
Figure 10:
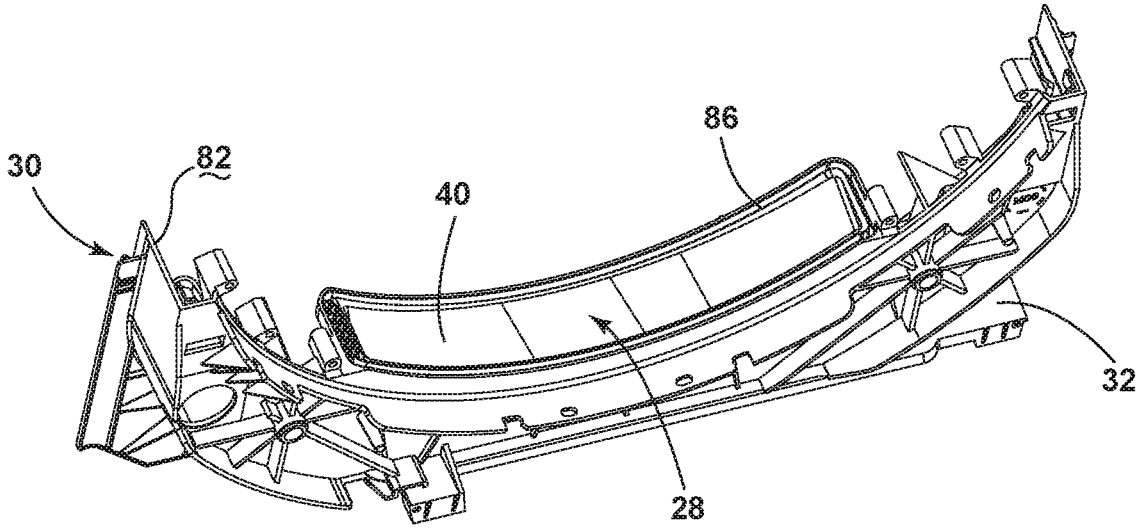
FIG. 10 is a top perspective view of a lower portion of the structural panel.
Figure 11:
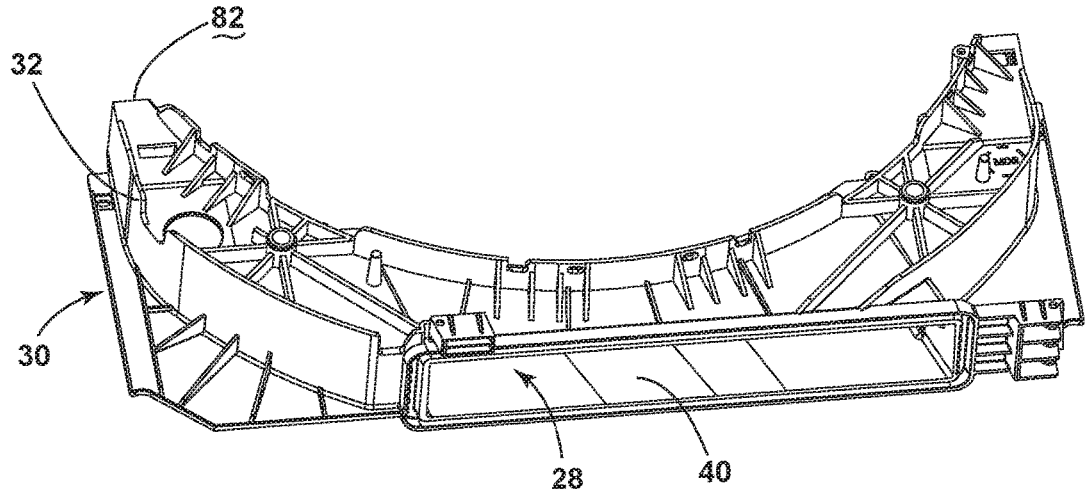
FIG. 11 is a bottom perspective view of the lower portion of FIG. 10.
Figure 12:
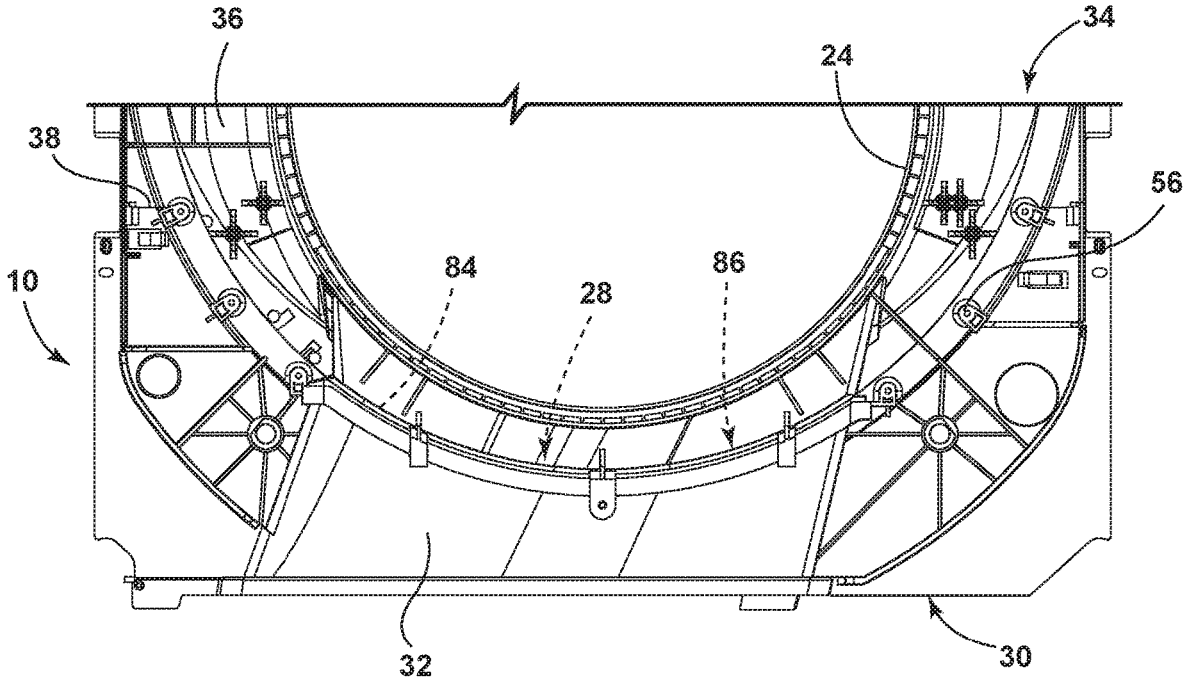
FIG. 12 is an enlarged elevational view of the structural panel of FIG. 7.
Figure 13:
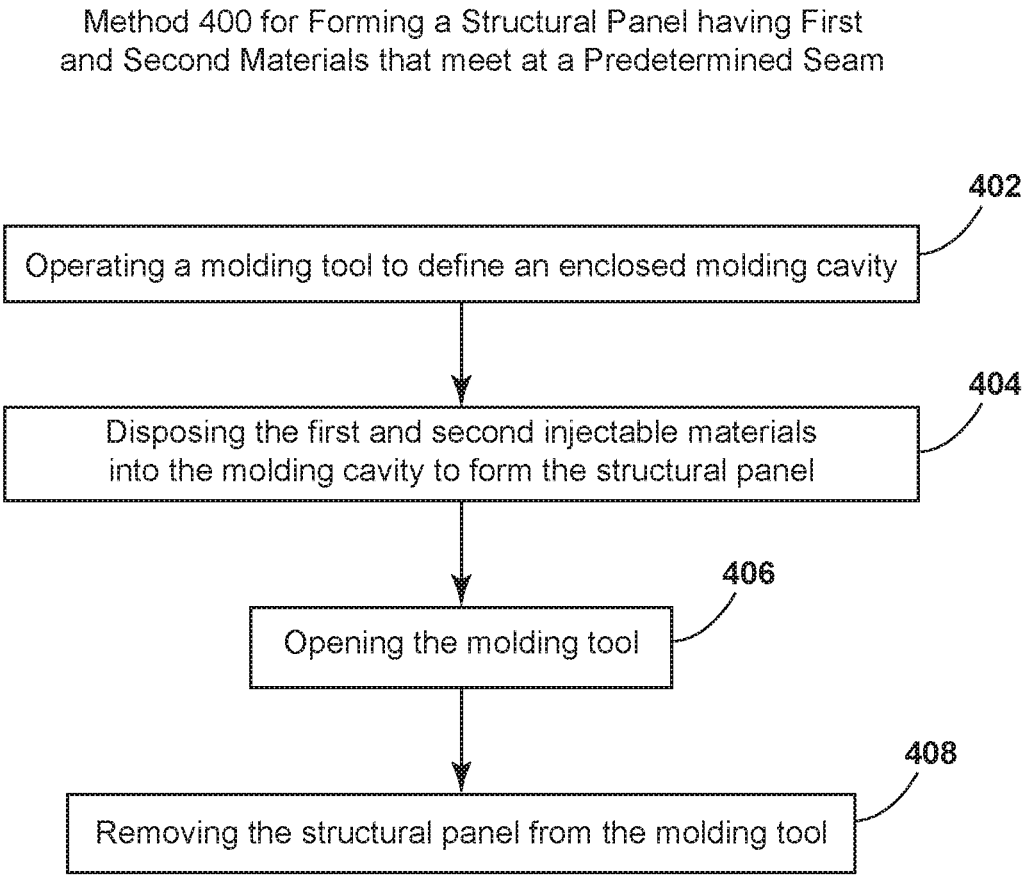
FIG. 13 is a linear flow diagram illustrating a method for forming a structural panel for a laundry appliance.
Figure 14:
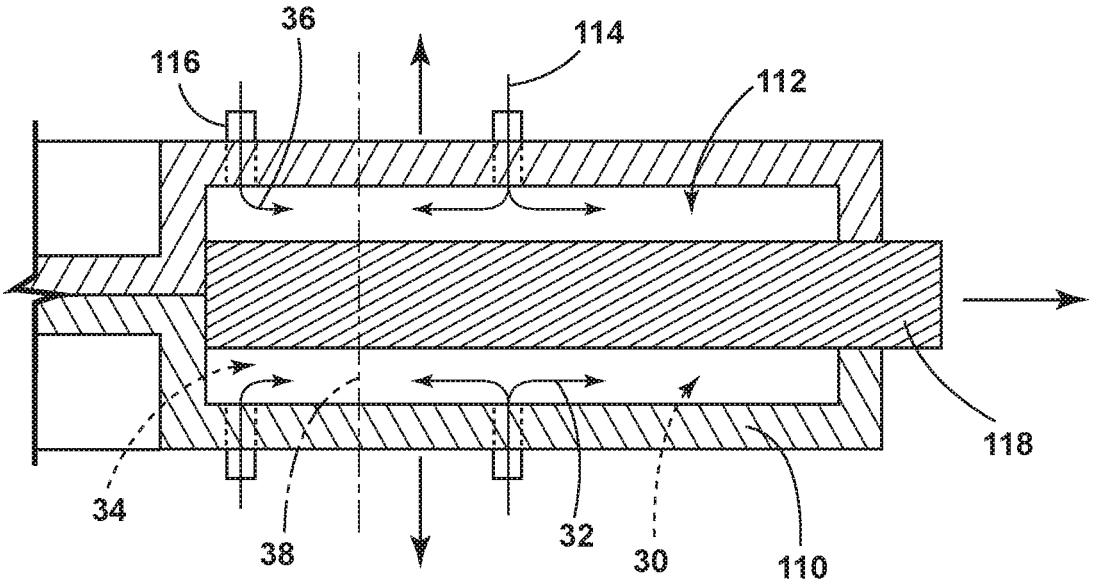
FIG. 14 is a schematic diagram illustrating an aspect of a molding tool for creating the structural panel.
Figure 15:
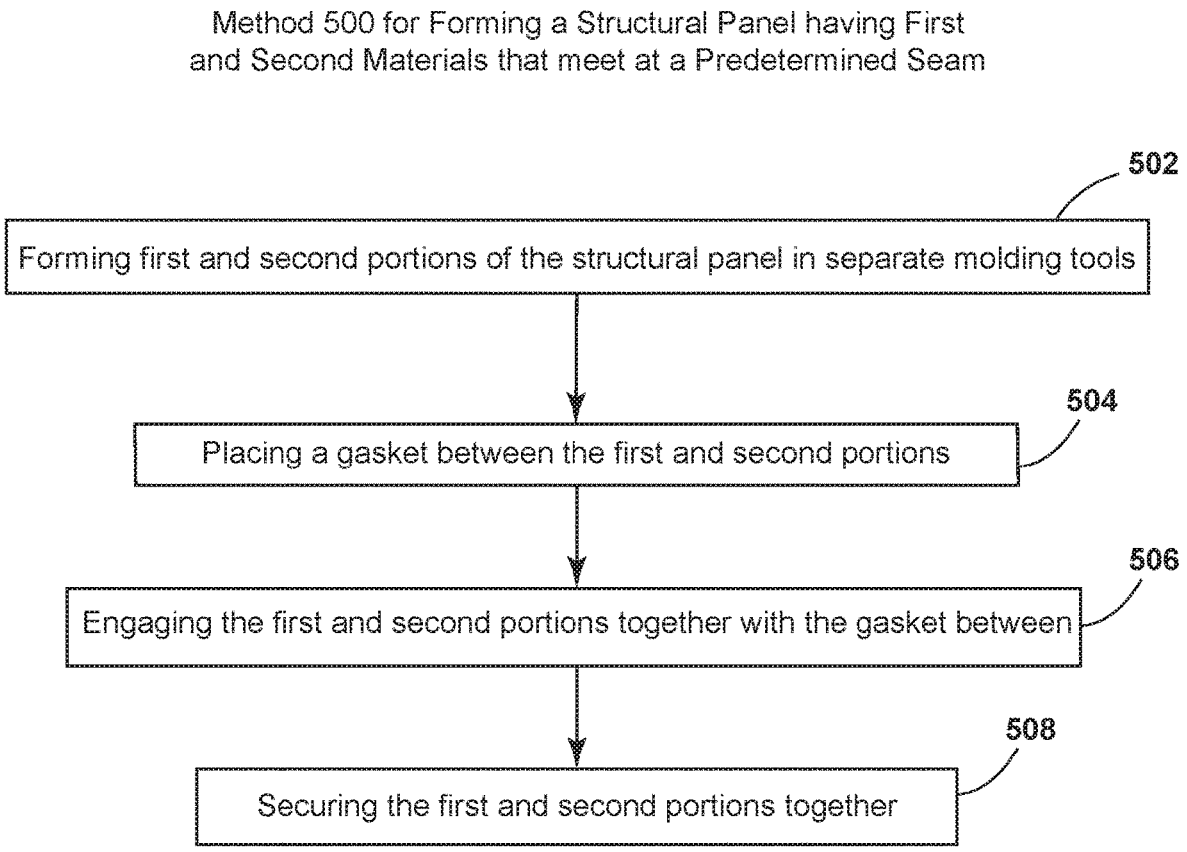
FIG. 15 is a linear flow diagram illustrating a method for forming a structural panel for an appliance.

Referring now to FIGS. 4-6, the first and second portions 30, 34 of the structural panel 10 can be co-molded portions. In such an embodiment, the first and second materials 32, 36 are co-molded to meet at or approximately at the predetermined seam 38 of the structural panel 10. The co-molding operation of the structural panel 10 can take place in a sequential operation where the first material 32 is injection molded at a separate time than that of the second material 36. It is also contemplated that the first and second materials 32, 36 can be contemporaneously co-molded within a molding cavity 112 of a single molding tool 110. Various injection ports 116 and other flow control devices can be used to ensure that the first and second materials 32, 36 meet at or at least near the predetermined seam 38 for the structural panel 10. As discussed above, the injection molding process also ensures that the first and second materials 32, 36 join at the predetermined seam 38 within the perimeter wall 40 that defines the air channel 28 for the structural panel 10.

Referring again to FIGS. 1-12, within this structural panel 10, the lower first portion 30 has the first material 32 that is heat resistant. The upper portion of the structural panel 10 is typically subjected to frequent impacts and general wear and tear during use of the appliance 12. This general wear and tear is typically in the form of insertion and removal of the removable air filter from the air filter receptacle 64 defined within the air channel 28 for the structural panel 10. Operation of a door 74 for the appliance 12 between the open and closed positions relative to the front aperture 24 can also cause wear and tear on the upper portion of the structural panel 10. By limiting the placement of the first material 32 having the heat resistant properties, this first material 32 can generally avoid the degree of general wear and tear experienced by the upper portion of the structural panel 10. By limiting wear and tear on the first material 32 within the lower portion of the structural panel 10, the integrity of the heat resistant material can be maintained for an extended period of time. Additionally, the upper portion made from the second material 36 can include a more robust material that is better able to absorb various impacts, scratches, and other wear and tear experienced during use of the laundry appliance 12.

According to various aspects of the device, as exemplified in FIGS. 5 and 6, the predetermined seam 38 extends below and at least partially around the front aperture 24 for the structural panel 10 to maximize placement of the first material 32 while also limiting the occurrence of potential wear and tear on the first material 32 so that the heat resistant properties of the first material 32 can be maintained for an extended period of time.

Referring now to FIGS. 7-12, the structural panel 10 for the laundry appliance 12 can also include separately molded first and second portions 30, 34 that are attached together at or near the predetermined seam 38. In such an embodiment, the predetermined seam 38 is defined by a bottom surface 80 of the upper portion and an upper surface 82 of the lower portion. In various aspects of the device, the upper and lower portions can be attached together by various fasteners 56 and fastening methods that can include, but are not limited to, mechanical fasteners, adhesives, welding, combinations thereof, and other similar attachment mechanisms and methods.

Where the first and second portions 30, 34 are attached, a gasket 84 extends around the air channel 28 at the predetermined seam 38. In this manner, one or both of the first and second portions 30, 34 at the predetermined seam 38 can include a gasket seat 86 that receives the gasket 84 that extends around the perimeter wall 40 that defines the air channel 28 for the structural panel 10. The gasket 84 can be made of an elastomeric-type material that extends around the air channel 28 and limits vibration that may be experienced between the engagement of the upper and lower portions of the structural panel 10. The gasket 84 also prevents infiltration of process air 20 from the air channel 28 to external areas outside of the air channel 28, such as within other portions of the predetermined seam 38, or other portions of the appliance 12 outside of the airflow path 22.

Referring again to FIGS. 1-4, the laundry appliance 12 can include the cabinet 18, where the drum 14 is disposed within the cabinet 18 for processing laundry. The blower 16 is adapted to deliver process air 20 from the heater 50 to the drum 14 via the airflow path 22. The structural panel 10 defines a portion of the airflow path 22 and includes the first portion 30 that is made of the first material 32 and the second portion 34 that is made of the second material 36. As discussed previously, the first portion 30 of the structural panel 10 is made from a different material than the second portion 34 of the structural panel 10. These first and second materials 32, 36 of the respective first and second portions 30, 34 at the predetermined seam 38 that extends through the perimeter wall 40 of the structural panel 10 defines the air channel 28. As discussed above, the structural panel 10 can typically define the front aperture 24 for accessing the interior 26 of the drum 14. In such an embodiment, the air channel 28 extends through and is defined within a wall of the structural panel 10 and at least partially defines the front aperture 24. Accordingly, the perimeter wall 40 that defines the air channel 28 extends downward from an opening 90 of the front aperture 24 and extends towards the base or bottom of the lower first portion 30 and toward the base or bottom of the lower first portion 30 and toward the basement 52 of the laundry appliance 12.

Referring again to FIGS. 1-12, the first and second materials 32, 36 can include various formable materials that can include, but are not limited to, plastics, various polymers, composite materials and other similar moldable materials that can be separately injection molded and attached together or injection molded within a single molding cavity 112 of a molding tool 110. Typically, the first material 32 defined within the lower first portion 30 of the structural panel 10 will have greater heat resistive properties than the second material 36 of the second upper portion. As discussed previously, the heat resistive properties of the first material 32 are used to address and at least partially mitigate the effects of a potential combustion event within the laundry appliance 12. Conversely, the second material 36 is typically a more robust material that can withstand various abuse and wear and tear events. These abuse and wear-and-tear events can be defined by installation and removal of the removable lint filter 62 and operation of the door 74 for the laundry appliance 12 between the open and closed positions.

Referring again to FIGS. 1-3, the structural panel 10 is typically an interior panel that is set behind an outer cosmetic panel 100 for the cabinet 18 of the appliance 12. The outer cosmetic panel 100, in combination with the structural panel 10, can include various openings 90 and apertures that are adapted to extend through both the cosmetic panel 100 and the structural panel 10. Such openings 90 can include, but are not limited to, the front aperture 24, the filter receptacle 64, secondary lint filter receptacles 102, chemistry receptacles 104 for detergent, bleach, fabric softener and the like, user interface portions 106, and other similar accessory openings 90 through the cosmetic panel 100 and the front panel 70 of the appliance 12.

Referring now to FIGS. 1-6, 13 and 14, having described various aspects of the structural panel 10 for the laundry appliance 12, a method 400 is disclosed for forming the structural panel 10 having the predetermined seam 38 that extends through a portion of the air channel 28 for the structural panel 10. According to the method 400, a molding tool 110 is operated to define an enclosed molding cavity 112 (step 402). Once the molding cavity 112 is enclosed, an injectable material 114, in the form of the first and second materials 32, 36, is disposed within the molding cavity 112 (step 404). As discussed above, various flow control devices and injection ports 116 are utilized for insuring that the predetermined seam 38 is accurately placed in the predetermined location for dividing the lower first portion 30 from the upper second portion 34. Various flow control devices are also included within the molding tool 110 for insuring that the predetermined seam 38 extends accurately around the perimeter wall 40 that defines the air channel 28. After injection of the formable material and cooling of a formable material, the molding tool 110 is separated or opened to provide access to the formed structural panel 10 (step 406). The structural panel 10 is then removed from the molding tool 110 (step 408). According to various aspects of the device, the molding tool 110 can include various lifters 118 and other mechanisms that can automatically separate the structural panel 10 from the molding tool 110.

Referring now to FIGS. 1-4, 7-12 and 15, having described various aspects of the structural panel 10 having the air channel 28 and the predetermined seam 38 that extends therethrough, a method 500 is disclosed for forming the structural panel 10. According to the method 500, first and second portions 30, 34 of the structural panel 10 are formed in separate molding tools 110 (step 502). After these first and second portions 30, 34 are formed, they are removed from their respective molding tools 110 for further assembly. The gasket 84 is placed between the first and second portions 30, 34 (step 504). Typically, the gasket 84 will be placed within a gasket receptacle of one of the first and second portions 30, 34 before the first and second portions 34 are attached together. The first and second portions 30, 34 are then engaged with one another such that the first and second portions 30, 34 meet at the predetermined seam 38 with the gasket 84 sandwiched between the first and second portions 30, 34 (step 506). As discussed above, the gasket 84 extends around the perimeter wall 40 that defines the air channel 28 within the structural panel 10. Fasteners 56 are then used to secure the first and second portions 30, 34 of the structural panel 10 together (step 508). These fasteners 56 can include, but are not limited to, welds, screws, rivets, adhesives, combinations thereof, and other similar attachment methods and mechanisms that can be used to attach the first and second portions 30, 34 that are made of different first and second materials 32, 36.

According to various aspects of the device, placement of the first and second materials 32, 36 is used to maximize the effect of heat resistant properties of a first material 32 and also maximize the robustness of the second material 36. The placement of the predetermined seam 38 is also meant to divide the lower portion of the structural panel 10 from the upper portion of the structural panel 10. Typically, the upper portion of the structural panel 10 will receive more wear and tear and abuse loads as a result of operation of the removable filter and the operable door 74 for the laundry appliance 12. By separating the first and second materials 32, 36 along the predetermined seam 38, the benefits of each material can be realized during use of the appliance 12 for minimizing the effects of a combustion event and also maximizing the ability of the structural panel 10 to resist wear and tear during use of the appliance 12.

According to various aspects of the device, the structural panel 10 having first and second portions 30, 34 that are made of the first and second materials 32, 36 can be used in various appliances 12. Such appliances 12 can include, but are not limited to, ovens, washing machines, dishwashers, water heaters, air handling devices, and other similar appliances 12 that may have need for heat resistive properties within an air channel 28.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A laundry appliance comprising:

a drum that processes laundry;

a blower that delivers process air from a heater to the drum via an airflow path; and a structural panel that defines a front aperture for accessing an interior of the drum and an air channel that defines a portion of the airflow path; wherein the structural panel includes a lower first portion that is made of a first material and an upper second portion that is made of a second material that is different from the first material; and the first and second materials meet at a predetermined seam that extends through the structural panel and the air channel.

2. The laundry appliance of claim 1, wherein the first and second portions are co-molded portions, wherein the first and second materials are co-molded to meet at the predetermined seam.

3. The laundry appliance of claim 1, wherein the first and second materials are separately molded and attached via fasteners at the predetermined seam.

4. The laundry appliance of claim 3, further comprising:

a gasket that extends around the air channel at the predetermined seam.

5. The laundry appliance of claim 1, wherein the first material is a first polypropylene material that includes approximately 20 percent talc.

6. The laundry appliance of claim 1, wherein the second material is a second polypropylene material that includes approximately 40 percent calcium tricarbonate particles.

7. The laundry appliance of claim 2, wherein the first and second materials are contemporaneously co-molded within a single molding tool.

8. The laundry appliance of claim 1, wherein the heater is an electrically resistive heating element.

9. The laundry appliance of claim 1, wherein the air channel defines an air filter receptacle.

10. A laundry appliance comprising:

a cabinet;

a drum disposed within the cabinet and that processes laundry;

a blower that delivers process air from a heater to the drum via an airflow path; and a structural panel that defines an air channel of the airflow path; wherein the structural panel includes a first portion that is made of a first material and a second portion that is made of a second material that is different from the first material; and the first and second materials meet at a predetermined seam that extends through a perimeter wall of the structural panel that defines the air channel.

11. The laundry appliance of claim 10, wherein the structural panel defines a front aperture for accessing an interior of the drum, and wherein the air channel extends through a wall of the structural panel and at least partially defines the front aperture.

12. The laundry appliance of claim 10, wherein the first and second portions are co-molded portions, wherein the first and second materials are co-molded to meet at the predetermined seam.

13. The laundry appliance of claim 10, wherein the first and second materials are separately molded and attached via fasteners at the predetermined seam.

14. The laundry appliance of claim 13, further comprising:

a gasket that extends around the air channel at the predetermined seam.

15. The laundry appliance of claim 10, wherein the first material is a first polypropylene material that includes approximately 20 percent talc and the second material is a second polypropylene material that includes approximately 40 percent calcium tricarbonate particles.

16. The laundry appliance of claim 12, wherein the first and second materials are contemporaneously co-molded.

17. The laundry appliance of claim 10, wherein the first portion of the structural panel is positioned proximate a heating element.

18. A structural panel for a laundry appliance, the structural panel comprising:

a lower first portion made of a first polypropylene material;

an upper second portion made of a second polypropylene material that is different than the first polypropylene material, wherein the upper second portion defines a front aperture for accessing a rotating drum;

an air channel that extends from the front aperture of the upper second portion to a base of the lower first portion, wherein:

the first and second materials meet at a predetermined seam that divides the lower first portion and the upper second portion; and the predetermined seam extends through a perimeter wall that defines the air channel.

19. The structural panel of claim 18, wherein the lower first and upper second portions are co-molded portions, wherein the first and second polypropylene materials are co-molded within a single molding tool to meet at the predetermined seam.

20. The laundry appliance of claim 18, wherein the first and second polypropylene materials are separately molded and attached via fasteners at the predetermined seam, and wherein a gasket is disposed proximate the perimeter wall at the predetermined seam, wherein the gasket extends around the air channel at the predetermined seam.

* * * * *